US006209455B1

(12) United States Patent
Simeth

(10) Patent No.: US 6,209,455 B1
(45) Date of Patent: Apr. 3, 2001

(54) PLATE CYLINDER AND PRINTING PLATE HAVING A FRICTION REDUCING LAYER THEREBETWEEN

(75) Inventor: Claus Simeth, Geisenheim-Johannisberg (DE)

(73) Assignee: MAN Roland Druckmaschinen AG (DE)

( * ) Notice: Subject to any disclaimer, the term of this patent is extended or adjusted under 35 U.S.C. 154(b) by 836 days.

(21) Appl. No.: 08/885,399

(22) Filed: Jun. 30, 1997

Related U.S. Application Data

(63) Continuation of application No. 08/601,823, filed on Feb. 15, 1996, now abandoned, which is a continuation of application No. 08/226,870, filed on Apr. 13, 1994, now abandoned.

(30) Foreign Application Priority Data

Apr. 30, 1993 (DE) ..... 43 14 398
May 7, 1993 (DE) ..... 93 07 099 U

(51) Int. Cl.[7] ..... B41F 27/00; B41N 1/00
(52) U.S. Cl. ..... 101/382.1; 101/395; 101/479
(58) Field of Search ..... 101/216, 375, 101/376, 415.1, 378, 401.1, DIG. 36, 401.3, 382.1, 395, 479; 33/619, 620, 621

(56) References Cited

U.S. PATENT DOCUMENTS 3,791,644 * 2/1974 DeMoore ..... 271/80
4,402,267 * 9/1983 DeMoore ..... 101/419
5,154,120 * 10/1992 Simeth ..... 101/375

FOREIGN PATENT DOCUMENTS 39 36 448 C1 4/1991 (DE) .

* cited by examiner

*Primary Examiner*—Kimberly Asher
(74) *Attorney, Agent, or Firm*—Leydig, Voit & Mayer, Ltd.

(57) ABSTRACT

To facilitate the attachment and adjustment of a printing plate on the outer surface of the plate cylinder of a printing machine, a layer of friction-reducing material is applied to the underside of the printing plate or the outer surface of the plate cylinder or both. The friction-reducing, sliding material may be a thermoset material, a thermoplastic material or an inorganic dry lubricant. The sliding material may be burnt into the supporting surface or bonded thereto by an adhesion promoting substrate layer.

9 Claims, 1 Drawing Sheet

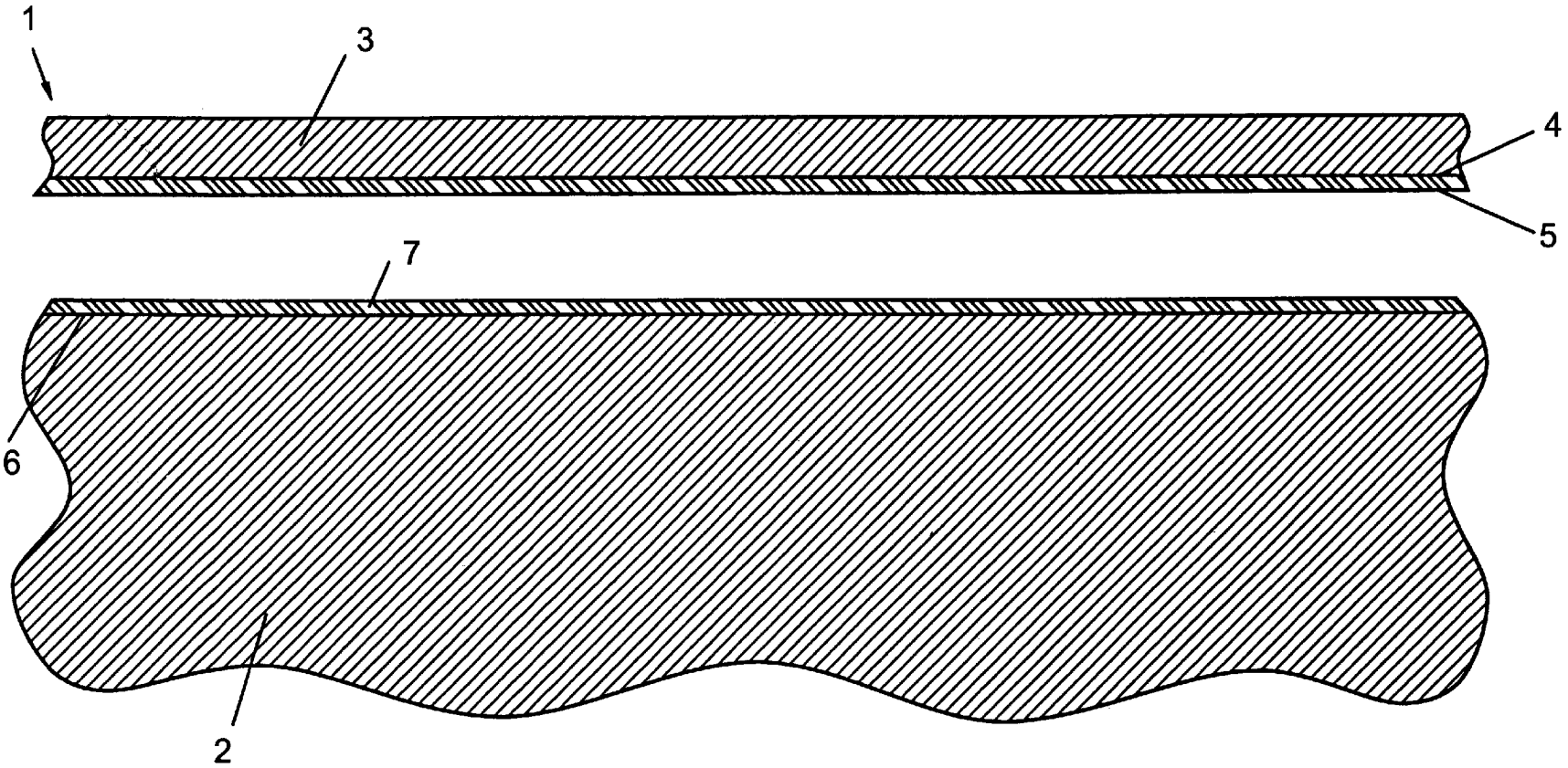
FIGURE

PLATE CYLINDER AND PRINTING PLATE HAVING A FRICTION REDUCING LAYER THEREBETWEEN

This is a continuation of application(s) Ser. No. 08/601,823 filed on Feb. 15, 1996, now abandoned which was a continuation of Ser. No. 08/226,870 filed Apr. 13, 1994, now abandoned.

TECHNICAL FIELD OF THE INVENTION

The present invention relates generally to a printing machine having a plate cylinder to which a printing plate can be attached on its outer surface, and more particularly concerns a friction-reducing layer between the surfaces of the printing plate and the plate cylinder.

BACKGROUND OF THE INVENTION

A conventional printing machine is described in DE 3,936,448 C1 corresponding to U.S. Pat. No. 5,154,120. In this conventional printing machine, a friction-reducing layer is provided comprising a foil arrangement having two foils placed one above the other between the plate cylinder and the printing plate. Each foil is coated with plastic such that one surface of the foil has a lower coefficient of sliding friction than the other surface. The foils are arranged such that the surfaces with the lower coefficient of sliding friction engage one another, thus allowing for displacement of the printing plate relative to the plate cylinder. As a result, the attachment and alignment adjustment of the printing plate on the plate cylinder is facilitated.

Because of the complex arrangement of foils associated with this convention printing machine, however, it is difficult to change the printing plate. Furthermore, the heat dissipation from the printing plate to the plate cylinder is adversely affected by the two foils. This results in a reduction of the temperature resistance of the printing plate.

OBJECTS OF THE INVENTION

Accordingly, it is the primary aim of the present invention to improve the ease of mounting and adjusting a printing plate on the outer surface of a plate cylinder in a printing machine.

It is a further object of the present invention to improve the heat transfer properties between the printing plate and plate cylinder in a printing machine.

A further object of the present invention is to improve the temperature resistance characteristics of a printing plate mounted on the outer surface of a plate cylinder in a printing machine.

All of these objects are realized in whole or part by one or more embodiments of the present invention. Other objects, as well as other inventive features of the present invention, will be apparent to one skilled in the art from the specification and appended claims.

BRIEF SUMMARY OF THE INVENTION

According to the invention, a friction-reducing layer in the nature of a sliding material is coated onto the outer surface of the plate cylinder. Alternatively, or in addition thereto, the friction-reducing layer may comprise a sliding material that is coated onto the underside of the printing plate.

DESCRIPTION OF THE FIGURE

The FIGURE is an enlarged, fragmentary cross sectional view of a printing plate and a plate cylinder, each of which include a friction-reducing layer.

DESCRIPTION OF THE PREFERRED EMBODIMENTS

Any number of sliding materials may be applied to or incorporated in the underside of the printing plate or the outer surface of the plate cylinder according to the present invention. Preferably, the sliding material comprises either a thermoset material, a thermoplastic material, or an inorganic dry lubricant. The thickness of the layer of sliding material is preferably about 10 $\mu$m.

According to the invention, the sliding materials can be burnt into the outer surface of the plate cylinder or the underside of the printing plate at a temperature of about 200° C. It is likewise possible to bond the sliding material to the plate cylinder or the printing plate by means of a substrate layer acting as an adhesion-promoting agent.

In the design of the plate cylinder of a printing machine according to the invention, the underside of the printing plate rests directly on the outer surface of the plate cylinder, thus eliminating the need for additional supporting foils. This considerably simplifies the handling and adjusting of the printing plate relative to the plate cylinder. A second advantage of the present invention is the enhanced heat transfer properties between the printing plate and plate cylinder. Compared to the known foils, the layers of sliding material in accordance with the preferred embodiments of the present invention have a layer thickness which is many times thinner, thus allowing a considerably improved heat dissipation over the plate cylinder. Furthermore, the direct support of the printing plate on the plate cylinder contributes to less deformation of the printing plate and thus to a higher degree of dimensional accuracy.

The sliding materials that are particularly suitable for coating the outer surface of the plate cylinder and the underside of the printing plate are described as follows. When the sliding material is a thermoset material, it is preferably a melamine alkyd resin coating, a polyester combination, a heat-curing acrylate product, an ethoxylin resin coating, or a silicone-modified combination thereof. If a thermoplastic material is employed, it is preferably polyvinyl chloride, polyvinyl chloride copolymer, polyvinyl fluoride, or polytetrafluoroethylene (PTFE). When the sliding material is an inorganic material, it is preferably graphite, molybdenum disulfide, or boron nitride.

With the sliding materials listed, coefficients of friction of between 0.04 for molybdenum disulfide or PTFE and 0.3 for boron nitride can be achieved. A layer thickness of 10 $\mu$m or even below is generally sufficient for purposes of the present invention. Prior to the coating, the substrate surface preferably is pretreated by blasting or anodic/chemical conversion. For a coating to be used within the printing works, it is possible for a lubricant substrate layer to be bonded onto the printing plate or the plate cylinder.

Due to the reduction in friction achieved by the coating according to the invention between the printing plate and the plate cylinder, the displacement of the printing plate relative to the plate cylinder is facilitated, such that the attachment and adjustment of the printing plate on the impression cylinder can be carried out in a simpler and more precise manner.

The invention is illustrated in the accompanying Figure, which illustrates a fragmentary view of a portion of a printing machine 1 comprising a plate cylinder 2 and a printing plate 3. The printing plate has an underside or lower surface 4 which is coated with a sliding material 5. The plate cylinder 2 includes an outer surface 6 for supporting the underside 4 of the printing plate 3. The outer surface 6 of the plate cylinder 2 also includes a sliding material 7 coated thereon.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references cited are herein incorporated by reference in their entireties.

What is claimed is:

1. A printing machine plate cylinder assembly comprising:

a plate cylinder having an outer cylindrical plate mounting surface, a printing plate having an inner cylindrical mounting surface for positioning about said plate cylinder, a separating medium between said printing plate and plate cylinder consisting solely of a layer of friction reducing material affixed to one of said mounting surfaces, and the other of said mounting surfaces having no layer of friction reducing material affixed thereon and being positioned in direct contacting relation with the friction reducing layer affixed to said one mounting surface for facilitating stable mounting of said printing plate in predetermined position on said plate cylinder with enhanced heat dissipation therebetween.

2. The printing machine cylinder assembly of claim 1 wherein said friction reducing material is selected from the group consisting of a thermoset material, a thermoplastic material, and an inorganic dry lubricant.

3. The printing machine cylinder assembly of claim 2, wherein said friction reducing material is a thermoset material selected from the group consisting of a melamine alkyd resin, a polyester, a heat-curing acrylate, an ethoxylin resin, and silicone-modified combinations thereof.

4. The printing machine cylinder assembly of claim 2, wherein said friction reducing material is a thermoplastic material selected from the group consisting of polyvinyl chloride, polyvinyl fluoride, polytetrafluoroethylene, polyvinylfluoride-polyvinylchloridecopolymer, and polytetrafluoroethylene-polyvinylchloridecopolymer.

5. The printing machine cylinder assembly of claim 2, wherein said friction inducing material is an inorganic dry lubricant selected from the group consisting of graphite, molybdenum disulfide, and boron nitride.

6. The printing machine cylinder assembly of claim 1 in which said friction reducing layer has a coefficient of friction between 0.04 and 0.3.

7. The printing machine cylinder assembly of claim 1 in which said friction reducing layer is affixed to said cylinder mounting surface and said plate mounting surface has no friction reducing covering.

8. The printing cylinder machine assembly of claim 1 in which said friction reducing layer is affixed to said plate mounting surface and said cylinder mounting surface has no friction reducing covering.

9. The printing machine cylinder assembly of claim 1 wherein said layer of friction reducing material has a thickness of about 10 $\mu$m.

* * * * *